United States Patent [19]

Scheinost

[11] Patent Number: 5,040,297

[45] Date of Patent: Aug. 20, 1991

[54] FIBERGLASS PANEL CUTTER WITH ADJUSTABLE SQUARE AND DUCT KNIFE

[75] Inventor: Jeffrey V. Scheinost, Dayton, Minn.

[73] Assignee: Malco Products, Inc., Annandale, Minn.

[21] Appl. No.: 444,534

[22] Filed: Dec. 1, 1989

[51] Int. Cl.[5] ..... B27G 17/02

[52] U.S. Cl. ..... 30/487; 30/491; 30/493

[58] Field of Search ..... 30/286, 287, 478, 480, 30/481, 487, 489, 491, 493

[56] References Cited

U.S. PATENT DOCUMENTS

| | | | |
|---|---|---|---|
| 332,305 | 12/1885 | Traut | 30/491 |
| 547,829 | 10/1895 | Williams | 30/491 |
| 636,983 | 11/1899 | Hanson | 30/491 |
| 752,532 | 2/1904 | Draughon | 30/491 |
| 1,012,591 | 12/1911 | Bodmer et al. | 30/487 |
| 1,026,053 | 5/1912 | Saner | 30/493 |
| 1,176,355 | 3/1916 | Fitzwater | 30/491 |
| 1,696,552 | 12/1928 | Org | 30/491 |
| 1,846,180 | 2/1932 | Black | 30/487 |
| 2,436,111 | 2/1948 | Lowe . | |
| 2,735,455 | 2/1956 | Forsberg . | |
| 2,869,599 | 1/1959 | Palm | 30/493 |
| 3,124,176 | 3/1964 | Vogini . | |
| 3,242,780 | 3/1966 | Ried et al. . | |
| 3,274,868 | 9/1966 | Williams . | |
| 3,296,702 | 9/1965 | Greenwood . | |
| 3,420,142 | 1/1969 | Gale et al. . | |
| 3,515,019 | 6/1970 | Tyler et al. . | |
| 3,605,534 | 9/1971 | Barr . | |
| 3,866,265 | 2/1975 | Beazley . | |
| 3,935,767 | 2/1976 | McClay . | |
| 3,941,018 | 3/1976 | Williams . | |
| 3,996,824 | 12/1976 | Cailey . | |
| 4,070,954 | 1/1978 | Cailey . | |
| 4,091,697 | 5/1978 | Cailey . | |
| 4,128,030 | 12/1978 | Kundikoff . | |
| 4,224,854 | 9/1980 | Malacheski et al. . | |
| 4,379,419 | 4/1983 | Woock et al. . | |
| 4,411,183 | 10/1983 | Auer . | |
| 4,584,772 | 4/1986 | Bergler | 30/481 |
| 4,608,902 | 9/1986 | Ivey . | |

OTHER PUBLICATIONS

A one-page brochure entitled "New! The FabMaster System".

An eight-page brochure entitled "Step-By-Step Guide To Using The FabMaster Hand-Groove Ductboard System: . . . ".

A one-page brochure on the Close-Master "48" fabrication machine.

A one-page brochure on the PC-36 Portable Fiber Glass Closure Machine.

A one-page brochure entitled "A New Look to an Old Master: the E215-T".

A one-page brochure on the GM 300 Grooving Machine.

A one-page brochure entitled "Groov-Master E215-T Call for the Workhorse . . . ".

A one-page brochure entitled "The Auto-Groover: Computer Controlled Fiber Glass Duct Maker".

A one-page brochure entitled "Fabrication Accessories".

A 12-page brochure entitled "Fabrication Manual."

A two-page brochure entitled "Glass Master Contract Prices".

(List continued on next page.)

*Primary Examiner*—N. Rachuba

*Attorney, Agent, or Firm*—Palmatier & Sjoquist

[57] ABSTRACT

The present fiberglass panel cutter includes a blade extractor tab for slightly displacing or deflecting scrap pieces of ductboard from their corresponding grooves, a blade height adjuster for controlling the depth of the groove, a blade with aligned apertures for ready removal from a blade mount, a canted handle, and a set of linear channels formed in a lower surface of the cutter for guiding the cutter in a straight line across the ductboard. The present invention further includes a knife with a blade set at a downward angle relative its handle to efficiently make cuts at an arm's length in ductboard which may measure four feet by eight feet. The present invention further includes a square that is infinitely adjustable and convertible between right and left handed orientations.

19 Claims, 7 Drawing Sheets

OTHER PUBLICATIONS

An Amcraft Inc. brochure entitled "Amcraft Kerfing Tools for Fabrication of Glass Fiber Ducts".

A Carter Donlevy Co. brochure entitled "Celco Duct Square".

A Miami Air Conditioning Inc. 3-page brochure entitled "Instructions for Fiber Board Duct Ruler".

FIBERGLASS PANEL CUTTER WITH ADJUSTABLE SQUARE AND DUCT KNIFE

The present invention relates to hand tools and, more particularly, to hand tools for cutting grooves in fiberglass panels.

BACKGROUND OF THE INVENTION

Fiberglass ductboard is typically utilized for constructing air ducts. The fiberglass ductboard arrives at construction sites in four foot by eight foot or eight foot by eight foot panels. Grooves are then cut into the ductboard where the ductboard is to be folded or bent so that the ductboard may be fashioned into box-like air ducts.

Fiberglass ductboard is typically one inch thick and includes an aluminum foil or staple flap layer on the front side. Grooves are often cut in the back side of the fiberglass within 1/16th of an inch of the foil layer, or right down to the foil layer without a piercing of the foil.

SUMMARY OF THE INVENTION

A feature of the present invention is the provision in a hand tool with a blade for cutting grooves in fiberglass ductboard, of a deflection blade portion disposed transversely of a blade cutting edge to slightly displace scrap pieces of ductboard from their respective grooves, whereby the scrap pieces of ductboard are easily removable by hand from the ductboard.

Another feature of the present invention is the provision in such a hand tool with a sled having a lower surface for bearing against the ductboard, of an incremental adjusting means fastening to the sled and the blade for incrementally adjusting the height of the cutting edge relative to the lower surface of the sled for controlling the depth of the groove.

Another feature of the present invention is the provision in such a hand tool, of linear channels formed in the lower surface of the sled and being substantially parallel to grooves being formed in the ductboard to guide the sled and blade in a straight line across and through the ductboard and facilitate easy sliding on the ductboard.

Another feature of the present invention is the provision in such a hand tool with a handle mounted on the sled by a pair of upwardly extending arms disposed transversely of each other, of a handle portion extending between the arms and being canted relative a lower surface of the sled to ergonomically accommodate the cutting of grooves.

Another feature of the present invention is the provision in such a hand tool with a blade plate disposed between the sled and the blade for securing the blade to the sled with at least one threaded pin, of aligned apertures formed in the blade and blade plate so that the threaded pin is readily accessible and the blade and blade plate are readily removable without removing the screw.

Another feature of the present invention is the provision in a duct knife with a handle and blade, of the blade being set at a downward angle relative the handle to efficiently make cuts at an arm's length in ductboard.

Another feature of the present invention is an infinitely adjustable square convertible between right handed and left handed orientations wherein the square includes a protractor with a curved slot and an arm with identical sets of holes formed in both ends.

An advantage of the present invention is that scrap pieces of ductboard are lifted cleanly out of their respective grooves.

Another advantage is that the depth of the groove is easily controlled to adjust for slight differences in the thicknesses of ductboards fabricated by different manufacturers, and to allow an individual to adjust the height of the blade in relation to his or her own unique pressure that is applied to the ductboard while cutting a groove.

Another advantage is that the sled of the present invention slides easily over the fiberglass to reduce arm and hand fatigue and allow the production of straighter grooves of a more uniform depth.

Another advantage is that the handle is ergonomically designed to accommodate the angle of the grip and reduce arm and hand fatigue.

Another advantage is that the blade is easily removable using a minimum of blade parts so that the blades may be quickly removed and replaced.

DETAILED DESCRIPTION OF THE PREFERRED EMBODIMENTS

Figure 1:
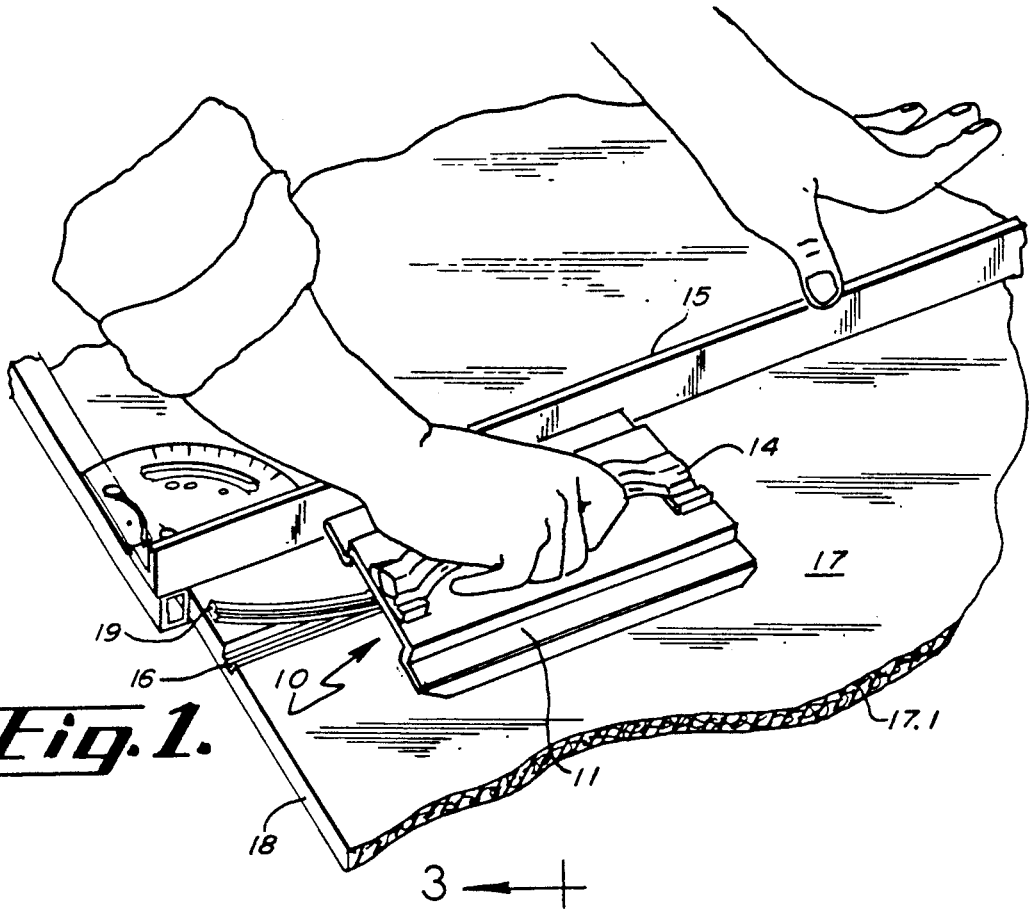
FIG. 1 is perspective view of the fiberglass panel cutter being guided by the square to cut a groove in fiberglass ductboard.
Figure 2:
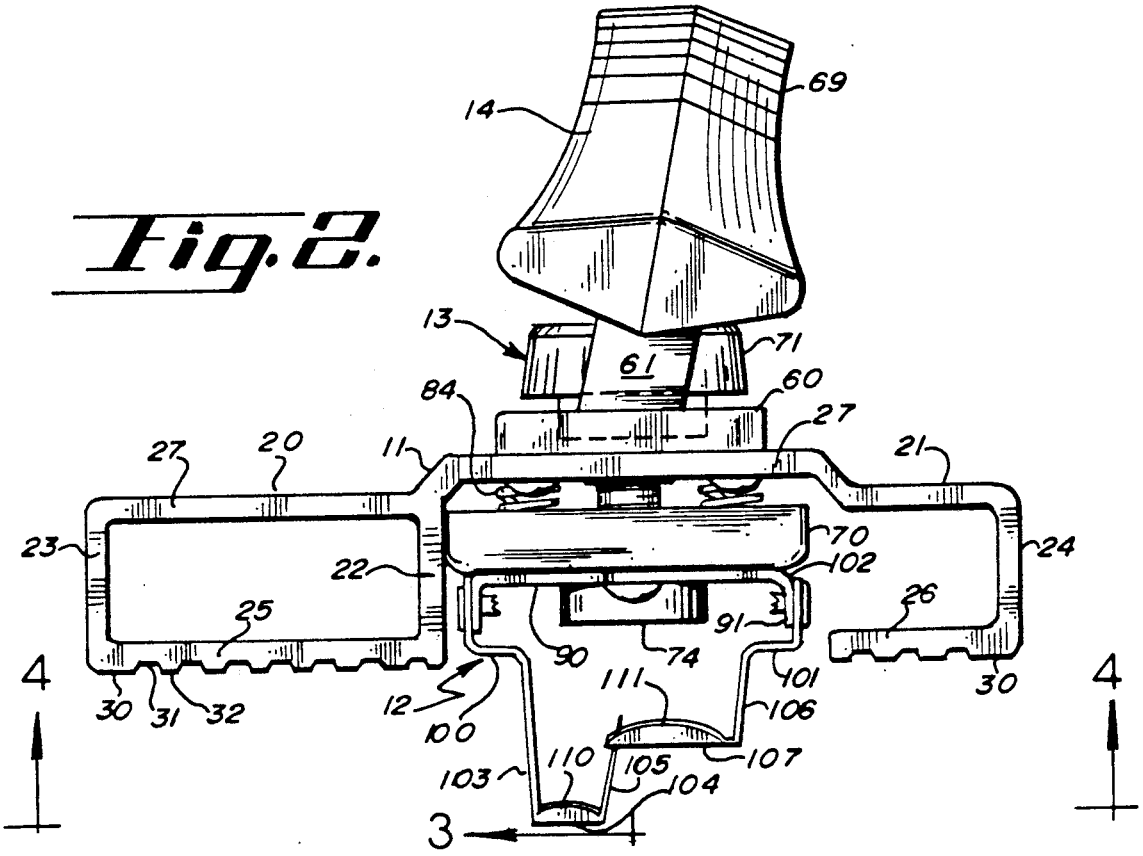
FIG. 2 is a detail rear elevation view of the fiberglass panel cutter of FIG. 1 with a blade that produces a left hand shiplap groove.
Figure 3:
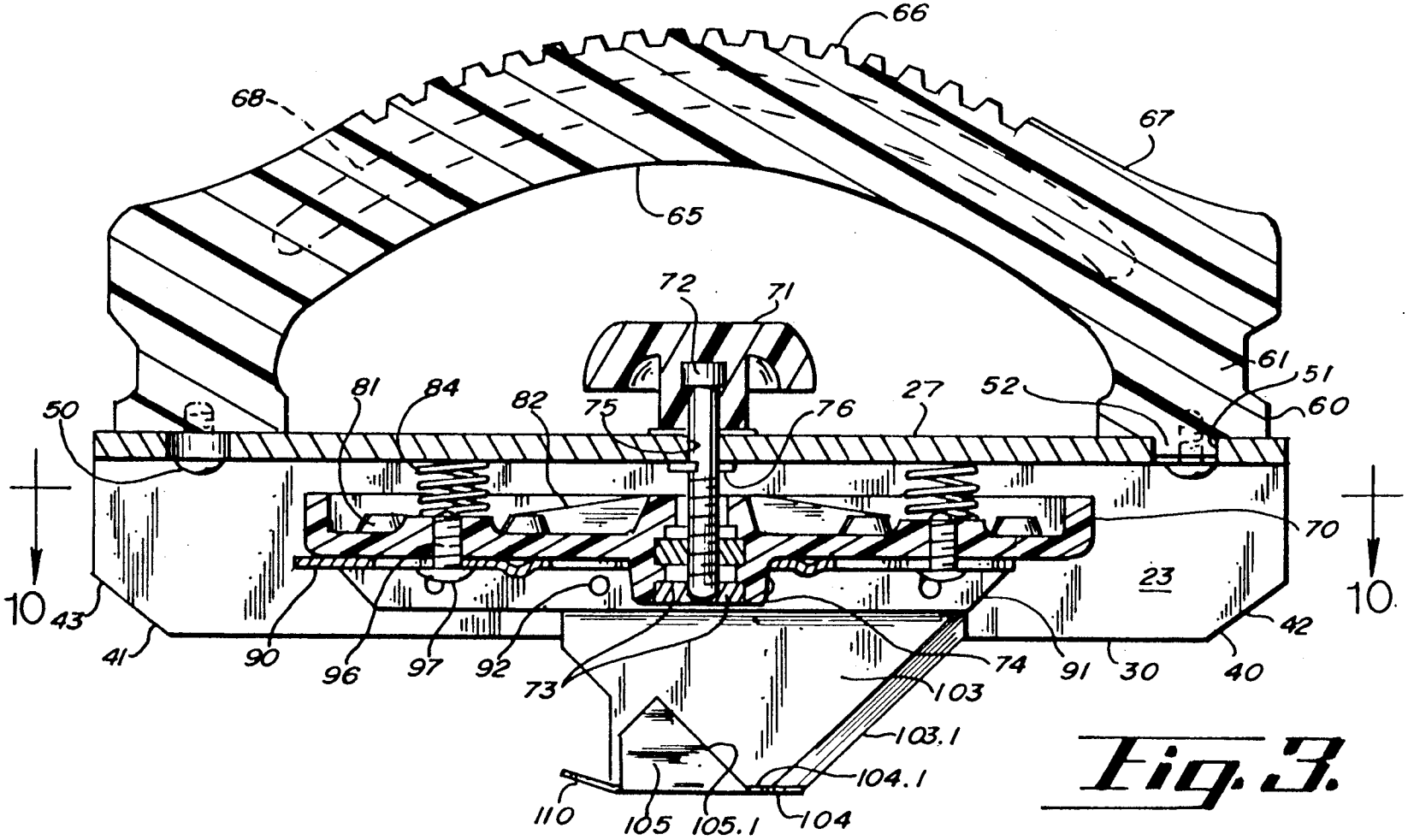
FIG. 3 is a detail section view of the fiberglass panel cutter along line 3—3 of FIG. 2.
Figure 4:
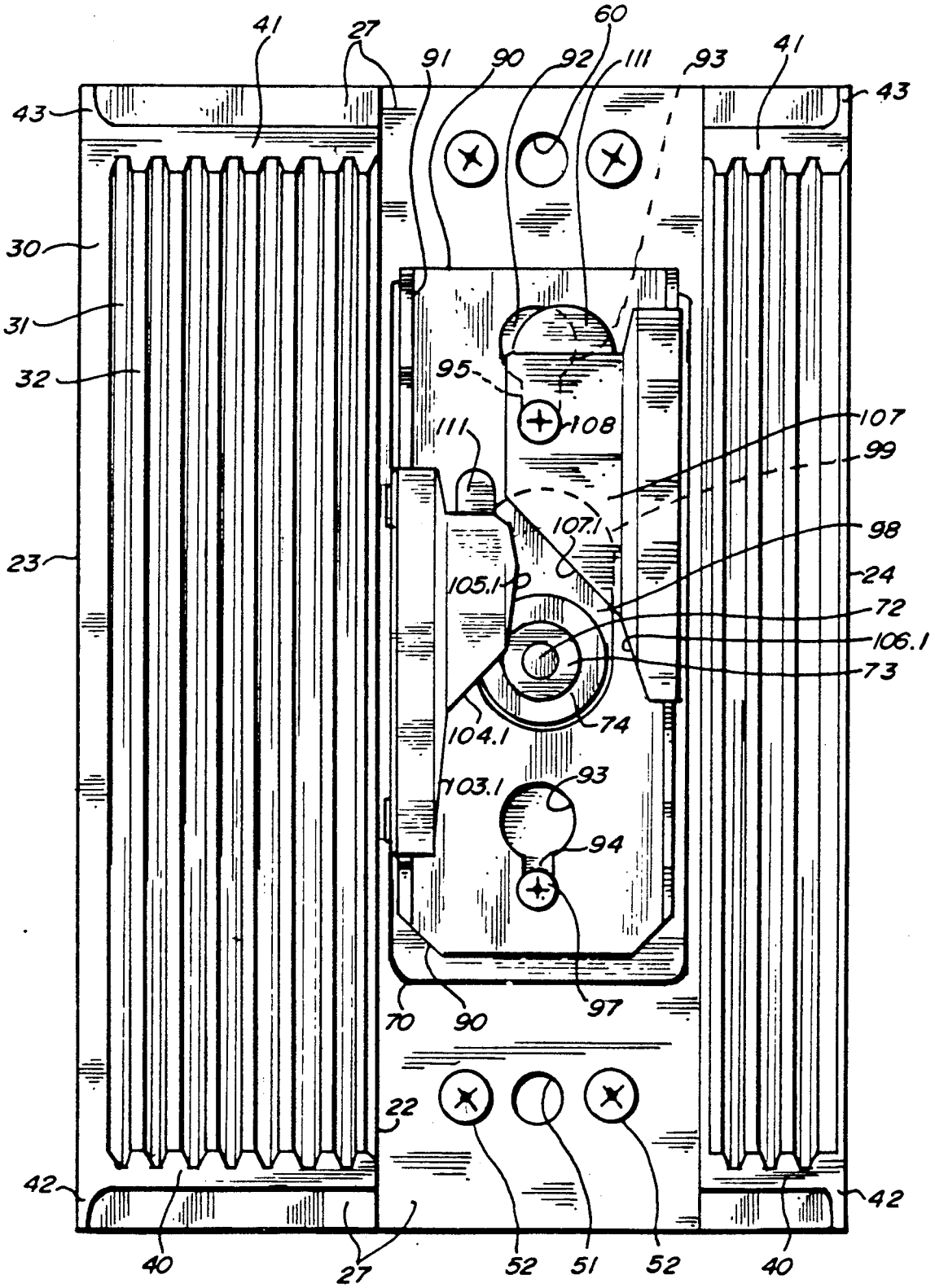
FIG. 4 is a detailed bottom plan view of the fiberglass panel cutter along line 4—4 of FIG. 2.

As shown in FIG. 1 and 2, the fiberglass panel cutter is indicated in general by the reference numeral 10 and includes as its principle components a sled or housing 11, a blade 12 for producing a left hand shiplap groove, a blade height adjusting means 13 for adjusting the height of the blade 12, and a canted handle 14. As also shown in FIG. 1, an infinitely adjustable square 15 guides the fiberglass panel cutter 10 during the cutting of a groove 16 in a fiberglass panel 17 having a fiberglass portion 17.1, and an aluminum foil or staple flap portion 18. The cutting of the groove 16 produces a scrap piece 19 of ductboard.

The sled or housing 11 includes a box-like portion 20 and a U-shaped portion 21 and is an extruded anodized aluminum. Box-like portion 20 includes an inner abutment wall 22. The box-like and U-shaped portions 20 and 21 include respective outer walls 23 and 24 and respective lower plates 25 and 26. Each of the portions 20 and 21 include an upper plate 27.

Each of the lower plates 25, 26 include a lower surface 30 for bearing against the fiberglass panel 17. The lower surface 30 includes a plurality of linear channels 31 and corresponding linear ridges 32 formed or extruded transversely in the plates 25, 26. The channels 31 decrease resistance of the the fiberglass panel 17 as the sled 11 is slid across the panel 17. The channels 31 and ridges 32 also serve to guide the sled 11 along a straight line as the groove 16 is being formed.

Each of the plates 25, 26 include respective front and rear tapering edges 40, 41 to facilitate the sliding of the plates 25, 26 across the panel 17. Each of the outer walls 23, 24 also include front and rear tapering edges 42, 43 which are formed linearly with the edges 40, 41.

Each of the ends of the upper plate 27 of the sled 11 includes a pair of screw receiving holes 50.1 for receiving screws 50 for mounting the handle 14. Each of the ends of the upper plate 27 also include a nub receiving aperture 51 for receiving a nub 52 formed integrally with the handle 14. The nub 52 is a locating feature for ease of assembly and conversion to the opposite hand fabrication method.

The handle 14 includes integral mounts 60 having threaded reinforced retainers or inserts for receiving screws 50. The handle 14 also includes arms 61 extending upwardly and being canted relative the mounts 60 and lower surface 30. The arms 61 typically extend at an acute angle of about 10° relative the lower surface 30, but may extend at an angle between about 5° and 20°. The handle 14 is reversible via the mounts 60 which are interchangeable to accommodate both left handed and right handed operators.

A handle 14 further includes an integral handgrip portion 65 which extends between the arms 61. The handgrip portion 65 is canted about 10° relative the lower surface 30 of the sled 11, but is mounted symmetrically relative the arms 61. The handgrip portion 65 is somewhat diamond-shaped in cross section from end to end and includes a plurality of ribs 66 formed on a top portion 67 and furrows 68 formed in each of the sides 69 of the handgrip portion 65.

The blade height adjusting means 13 includes a plastic blade mount 70 and a hand knob 71 having a fixed threaded shaft 72. The shaft 72 cooperates with the blade mount 70 via threaded reinforced retainers or inserts 73 fixed in the mount 70. One of the retainers 73 is set in a lower boss 74 formed integrally with the mount 70. The shaft 72 extends through an aperture 75 formed in upper plate 27. The shaft 72 includes a fixed washer 76. The fixed washer 76 prohibits vertical uplift or slippage of the hand knob 71 if, for instance, an abnormally high force is brought to bear on the blade mount 70. It should also be noted that blade mount 70 bears against inner wall 22 of sled box-like portion 20 to maintain the blade mount 70 and blade 12 parallel relative to the linear channels of the bottom surface 30. The blade mount 70 is drawn incrementally up or down relative the upper plate 27 and lower surface 30 when the knob 71 is turned.

An upper surface portion 80 of the mount 70 includes a set of 12 coil spring receiving nubs 81 and a plurality of ridges 82 which also form a ridge-like border 83. Typically a set of eight coil springs or resilient means 84 are disposed between the mount 70 and the upper plate 27 of the sled 11 to bias the mount 70 and plate 27 away from each other. The coil springs 84 may be disposed on the nubs 81 or between the ridges 83 and border 83. Eight to sixteen or more coil springs 84 may be disposed between the mount 70 and upper plate 27. The number of coil springs 84 may control the stability of mount 70. Typically, eight coil springs 84 are sufficient to prevent the mount 70 from self-adjustment in height during transport, storage or operation. It should also be noted that the ridges 83 form ridge-like bosses 85 for forming apertures in which screw receiving reinforced threaded retainers or inserts 86 are set.

The blade 12 includes a upper blade plate or support 90 and a pair of opposing integral side lips 91. The blade support 90 includes holes 92 formed by edges 93 and slots 94 formed by edges 95. The holes 92 and slots 94 form keyhole-like apertures. The slots 94 extend into the holes 92. Screws 96 with heads 97 fasten the blade support 90 to the blade mount 70. Screws 96 cooperate with the retainers or threaded inserts 86 fixed in the mount 80. The heads 97 of the screws 96 are smaller in diameter than the holes 92, but are greater in width than the slots 94. The blade support 90 also includes a larger slot 98 formed by edges 99 for receiving the boss 74 of the blade mount 70. The blade support 90 is removable from the mount 70 by slightly loosening the screws 96 and sliding the blade support 90 forwardly until the screw heads 97 are receivable through the holes 92.

It should be noted that the blade support 90 is retained on the blade mount 70 even if, for instance, the screws 96 are somewhat loose. The screws 96 bear against front portions of slot edges 95 when the blade support 90 is biased toward the rear, such as when the cutter 10 is being pushed forwardly in a cutting operation.

The blade 12 includes two blade portions 100, 101. Each of the blade portions 100, 101 is secured to the lips 9 of the blade support 90 via rivets 102. Blade portion 100 includes vertical blade sections 103 with cutting edge 103.1, horizontal blade section 104 with cutting edge 104.1, and vertical blade section 105 with cutting edge 105.1. Blade portion 101 includes vertical blade section 106 with cutting edge 106.1 and horizontal blade section 107 with cutting edge 107.1. Vertical blade sections 103, 105, 106 produce vertical cuts. Horizontal blade sections 104, 107 produce horizontal cuts. Blade section 107 includes a blade aperture 108 that is aligned with the retainers 86 and corresponding screw head 97 for receiving a screwdriver for loosening its respective screw head 97.

Each of the blade portions 100, 101 include respective extractor tabs or deflection portions 110, 111. The extractor tabs 110, 111 are formed integrally with the blade portions 100, 101 and extend rearwardly and upwardly from trailing rear portions of the blade sections 104, 107. Each of the extractor tabs 110, 111 is located opposite of the horizontal cutting edges 104.1, 107.1 and is somewhat elongate and semicircular. The tabs 110, 111 extend inwardly relative its corresponding scrap piece 19 of ductboard to displace or dislodge the scrap piece 19 slightly from the groove 16 as the scrap piece 19 is being formed. It should be noted that similar extractor tabs may be formed on vertical blade sections 103, 105 and 106.

One of the purposes behind the rearward and upward orientation is to gradually provide an upward movement to the scrap piece 19. One of the purposes behind the semicircular shape is to minimize resistance as the scrap piece 19 slides over the top point of each of the semicircular extractor tabs 110, 111.

In operation, when a left hand shiplap groove is to be formed such as with blade 12 of sled 11 by a right handed operator, the adjustable square 15 is set at a predetermined distance from the right edge of the cut previously produced in the ductboard panel 17. The left wall 23 of the sled 11 is then disposed adjacent the square 15 and pushed forwardly. The front tapering edges 40, 42 are typically the first portions of the bottom surface 30 to bear against the fiberglass portion 17.1. As the bottom surface 30 then slides on the fiberglass portion 17.1, the ridges 32 bear somewhat into the fiberglass portion 17.1 to assist in maintaining a linear motion. The cutting edges 103.1, 104.1, 105.1, 106.1, and 107.1 subsequently cut into the fiberglass portion 17.1 to form the groove 16 and a corresponding scrap piece 19 of ductboard. Almost immediately after the groove 16 and scrap piece 19 begin to be formed, the extractor tab 110 lends an upward push to and slightly displaces or dislodges or deflects the scrap piece 19 being formed from the groove 16. Subsequently, the extractor tab 111 lends another upward push to assist in the displacement of the scrap piece 19 from the groove 16. After the cutter 10 moves completely across the fiberglass panel 17, the scrap piece 19 that has been slightly displaced or dislodged from the groove 16 is readily picked up by hand and removed the groove 16.

The depth of the groove 16 is controlled by turning the knob 71 to draw the blade mount 70 and blade 12 up and down relative the bottom surface 30 of sled 11. Blade 12 is removable from the mount 70 by slightly loosening without removing screws 96 and sliding the blade 12 forwardly in the slots 94 and from the screw heads 97 via the apertures 92. The handle 14 is reversible by operation of the screws 50.

Figure 5:
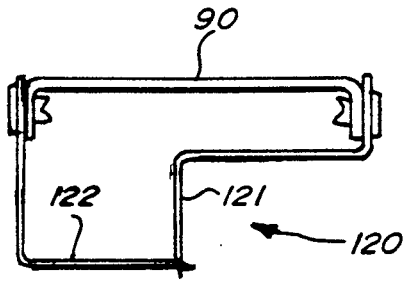
FIG. 5 is a rear elevation view of a blade typically utilized on the left edge of a panel of ductboard by a right handed user to produce a female shiplap groove.

Blade 120 shown in FIG. 5 typically includes no extractor tabs, such as extractor tab 110 or 111. One reason for the absence of a tab is that blade 120 usually forms a female shiplap groove on the left edge of a sheet of ductboard for a right handed user and is reversible and also forms a female shiplap groove on the right edge of a sheet for a left hand user. The corresponding scrap piece of ductboard thus formed typically falls off on its own from the ductboard panel 17. However, if desired, integral extractor tabs may be mounted on rearward portions of vertical blade section 121 and/or on horizontal blade section 2. Blade 120 may also include apertures such as apertures 108.

Figure 6:
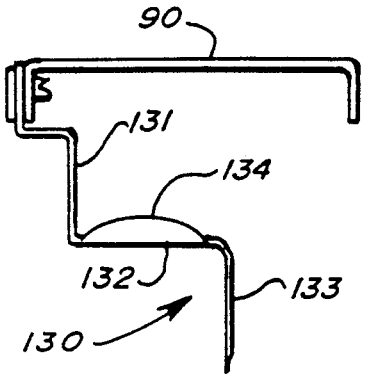
FIG. 6 is a rear elevation view of blade that is typically utilized to cut completely through the panel, including its aluminum foil, to create duct sections shorter than the standard four foot length and form a female shiplap groove.

Blade 130 shown in FIG. 6 includes three cutting blade sections 131, 132, and 133. Sections 131, 133 produce vertical cuts; section 132 produces a horizontal cut and includes a rearwardly mounted integral extractor tab 134. Blade 130 is typically utilized to cut through the fiberglass panel 17, including the foil 18, to create duct sections shorter than the standard four foot length. Blade 130 forms a female shiplap groove. Vertical blade section 131 may include an extractor tab. Blade section 131 may include the aperture 108.

Figure 7:
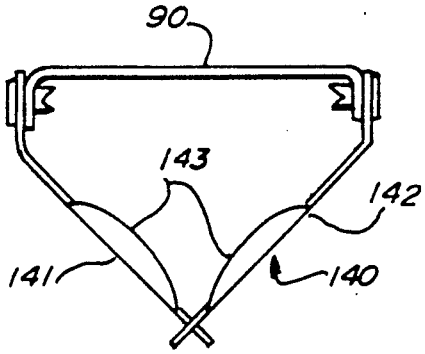
FIG. 7 is a rear elevation view of a blade that produces a vee groove.

Blade 140 shown in FIG. 7 includes two cutting blade portions 141, 142 extending downwardly and toward each other. Each of the portions 141, 142 include an integral extractor tab 143 located on rearward, lower positions of the blade portions 141, 142. Blade 140 produces a vee groove and may include the aperture 108.

Figure 8:
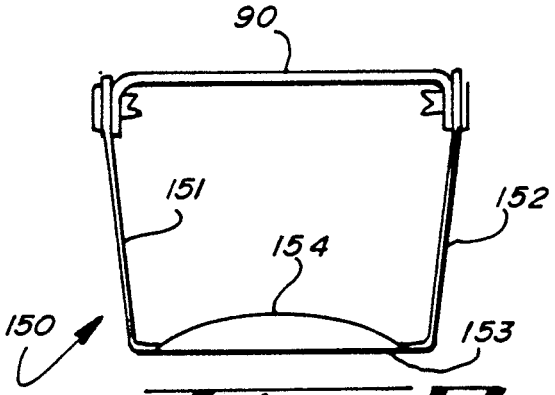
FIG. 8 a rear elevation view of a blade that produces a staple flap groove.

Blade 150 shown in FIG. 8 produces a staple flap groove and includes three cutting blade sections 151, 152, 153. Blade sections 151, 152 produce vertical cuts; blade section 153 produces a horizontal cut and includes an integral extractor tab 154 mounted on a rear portion of the section 153. Vertical blade sections 151, 152 may include extractor tabs. Horizontal blade section 153 typically includes two apertures 108.

Figure 9:
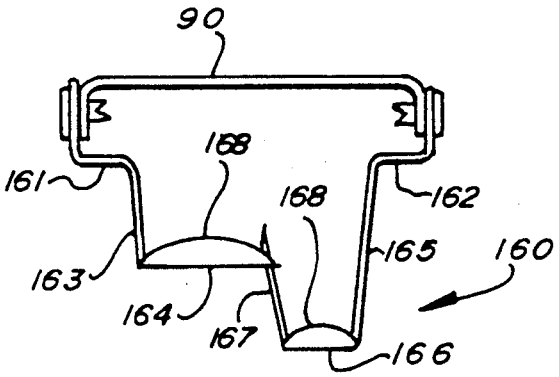
FIG. 9 is a rear elevation view of a blade that produces a right hand shiplap groove.
Figure 10:
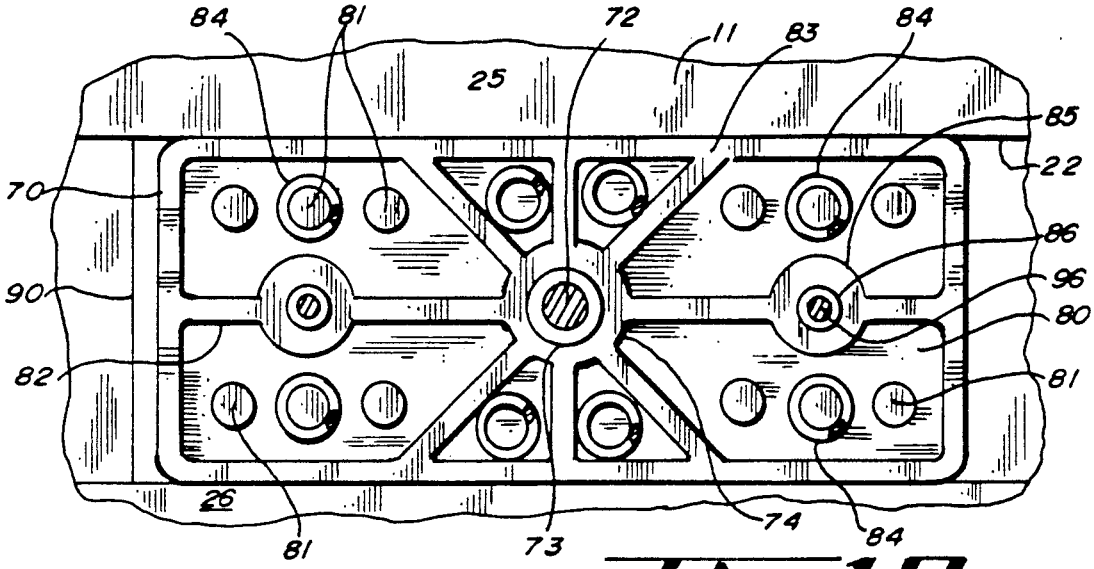
FIG. 10 is detail bottom plan view of a section of the blade mount of the cutter along line 10—10 of FIG. 3.
Figure 11:
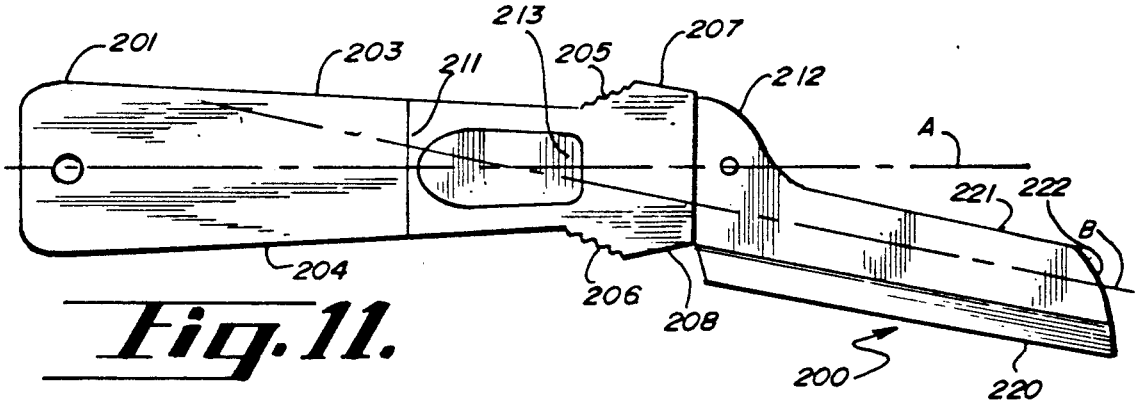
FIG. 11 is a side elevation view of the duct knife.
Figure 12:
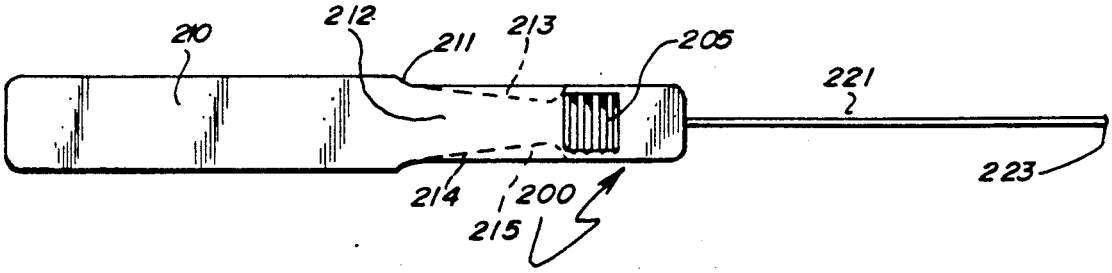
FIG. 12 is top plan view of the duct knife of FIG. 10.
Figure 13:
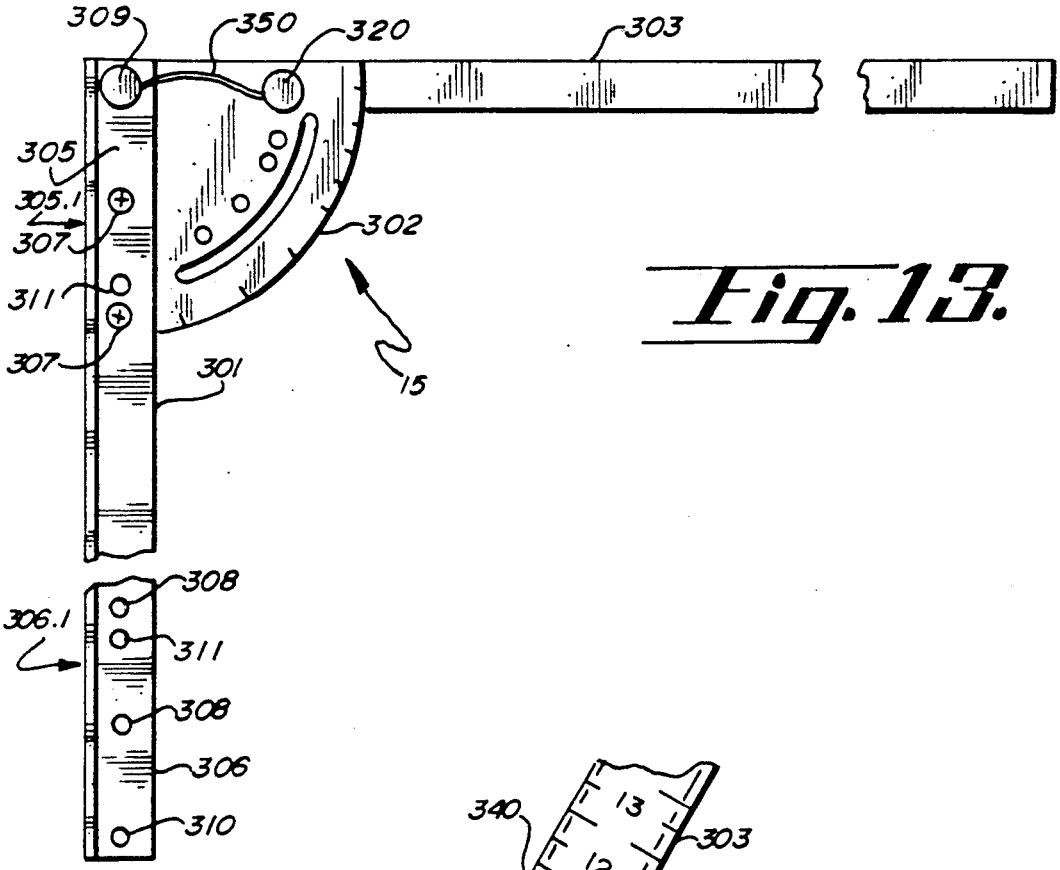
FIG. 13 is a partial, top plan view of the layout square.
Figure 14:
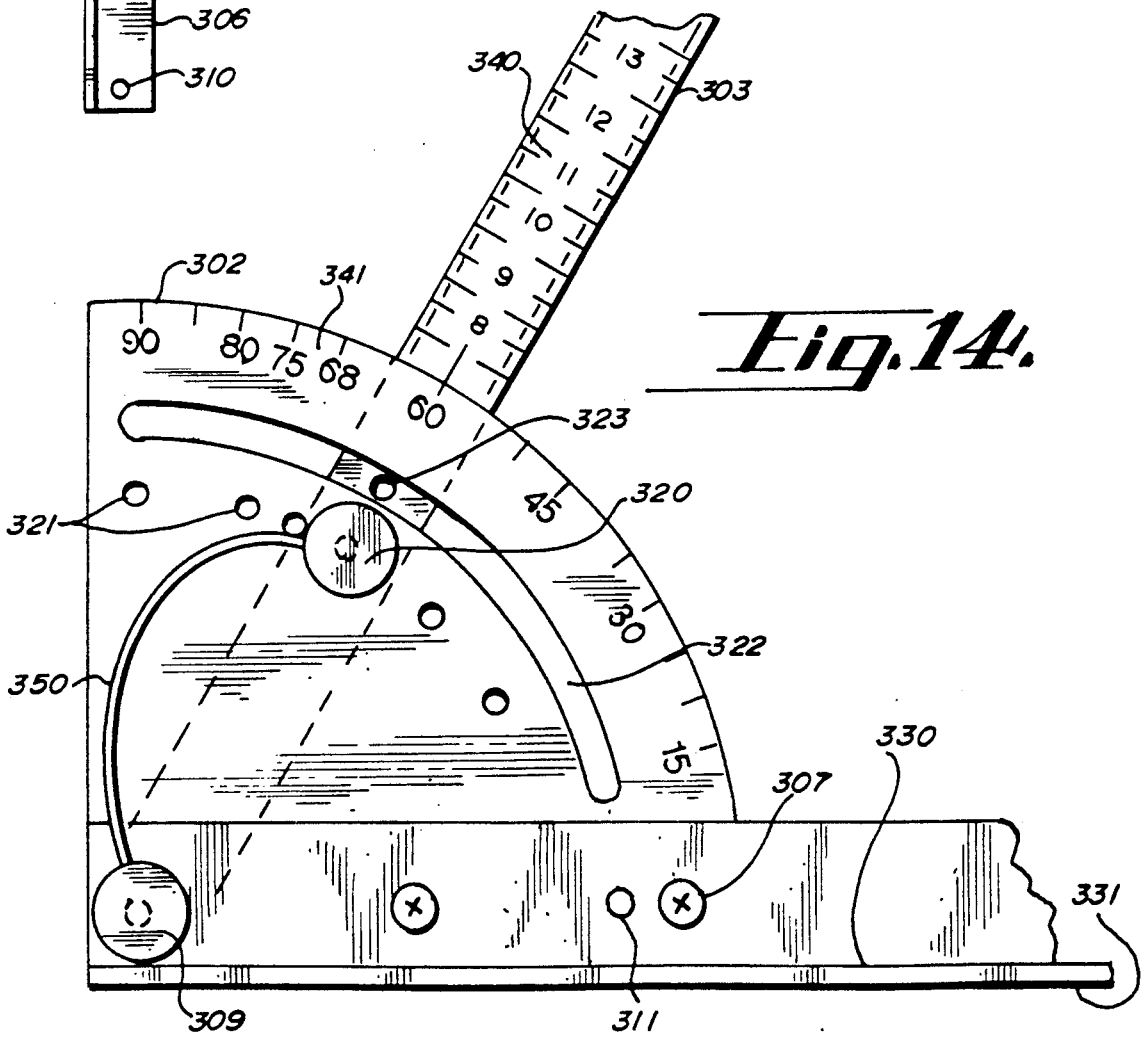
FIG. 14 is a detail top plan view of the square of FIG. 12.

Blade 160 shown in FIG. 9 produces a right hand shiplap groove and includes two blade portions 161, 162. Blade portion 161 includes blade sections 163, 164. Blade portion 162 includes blade sections 165, 166 and 167. Sections 163, 165 and 167 make vertical cuts. Sections 164, 166 make horizontal cuts and include integral extractor tabs 168 mounted on rear portions. Extractor tabs may be mounted on vertical blade sections 163, 165 and 167. Horizontal blade section 164 includes aperture 108.

The duct knife 200 includes a handle 201 and a blade 202. The handle 201 includes upper and lower tapering edges 203, 204 extending inwardly and toward the blade 202. The edges 203, 204 lead into ribbed edges or raised finger stops 205, 206 which extend outwardly to the blade abutting edges 207, 208 to minimize finger slippage into the blade 202. Handle 201 further includes a gripping portion 210 which narrows at a transitional portion 211 to blade mounting portion 212. The thickness of portion 210 is slightly greater than the thickness of portion 212. Portion 212 includes indents 213 for receiving a thumb or finger for controlling the knife 200. Indents 213 are formed on both sides to accommodate both right and left handed operators and include shallow portions 214 which lead into deep portions 215.

Blade 202 is fixedly set in the handle 201 and includes a cutting edge 220. Blade 202 further includes an upper linear flat dull edge 221 which leads into a rounded flat dull edge 222 disposed near a front end 223 of the the blade 202. Edge 222 is sufficiently thin to slice into and through the fiberglass portion 17.1 of the fiberglass panel 17, but is sufficiently dull and curved so that it is difficult to slice through or pierce the aluminum foil 18.

Handle 201 includes a central axis A running through the handle 201. Blade 202 includes an axis B that is parallel to linear edge 221 and blade edge 220. Axes A and B form an angle of about 10°. Such an angle permits sufficient, ergonomical control of the knife 200 when cutting through fiberglass ductboard by minimizing the degree to which the wrist is turned or cocked to produce a downward cutting motion, especially when the cutting is performed at an arm's length.

The layout square 15 includes as its principle components an angle arm 301, a protractor 302 removably securable through the angle iron 301, and a channel arm 303 removably securable to the protractor 302 and angle arm 301. Arm 301 includes opposite ends 305, 306. The convertible square 15 is adaptable for both right and left handed users by virtue of two sets of holes formed in opposite ends 305, 306 of the angle arm 301. The sets of holes 305.1, 306.1 are mirror images of each other about a mid point of the angle arm 301. The protractor 302 is removably securable via screws 307 to two of the four threaded holes 308 formed in both ends 305, 306 and a thumb knob locknut or pin connector 309 cooperating with threaded holes 310. Likewise, channel arm 303 is removably securable to threaded holes 310 of the angle arm 301 so that the square 15 accommodates both right and left handed users. Threaded holes 311 are typically used for securing channel arm 303 to the angle arm 301 when the square 15 is pivoted to a compact, linear orientation for storage.

Channel arm 303 is removably and pivotably secure to the protractor 302 and the angle arm 301 via thumb knob locknut 309. The channel arm 303 is removably securable to protractor 302 with a second thumb knob locknut or pin connector 320. Thumb knob locknut 320 cooperates with one of the holes 321 for finite adjustment at angles of 30°, 45°, 60°, 68°, 75°, 80° and 90°. Thumb knob locknut 320 also cooperates with a curved slot 322 for infinite angle adjustment from 15° to 90°. Thumb knob locknut 320 cooperates with threaded holes 323 formed in channel arm 303 for locking the channel arm 303 to the protractor 302 when utilizing the slot 322 or holes 321.

It should further be noted that angle arm 301 is an angle iron with side 330 providing a surface 331 against which outer wall 23 of the sled 11 slides for right handed users. Channel arm 303 is a U-channel of a height of about one inch so that its top surface is flush with standard ductboard for the angle arm 301.

It should further be noted that a plurality of digits 340 such as "11" are stamped into the top surface of the channel arm 303 so that the digits 340 are readable in the same orientation to both right and left handed users. In other words, the digits are in an upright position relative side 330 of the angle arm 301 when the channel arm 303 is set at a 90° angle relative the angle arm 301. The digits 341 such as "68" of the protractor 302 are stamped on both sides of the protractor 302 to accommodate both right and left hand users.

A thumb knob harness or flexible element 350 is fastened to and between the thumb knob locknuts 309, 320. The harness 350 is flexible and minimizes misplacement or chance of loss of the thumb knob locknuts 309, 320 when either of the thumb knob locknuts 309, 320 has been removed from the square 300.

Figure 15:
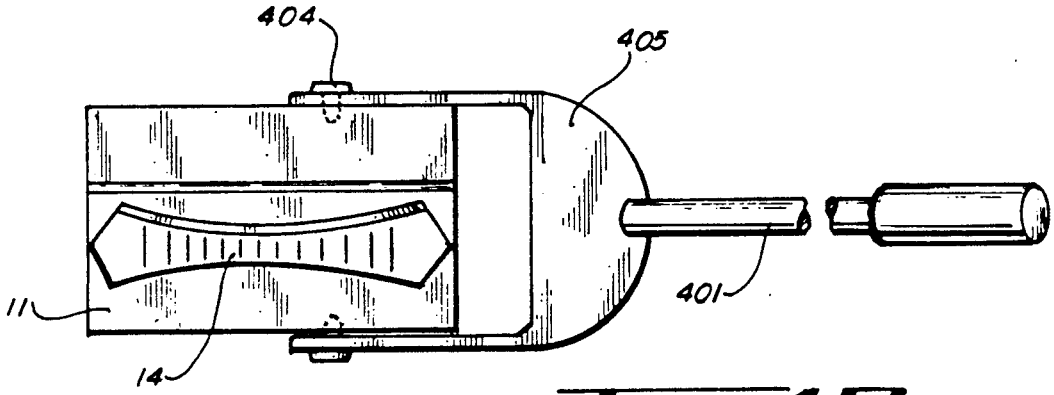
FIG. 15 is a top plan view of one form of extension handle securable to the cutter.
Figure 16:
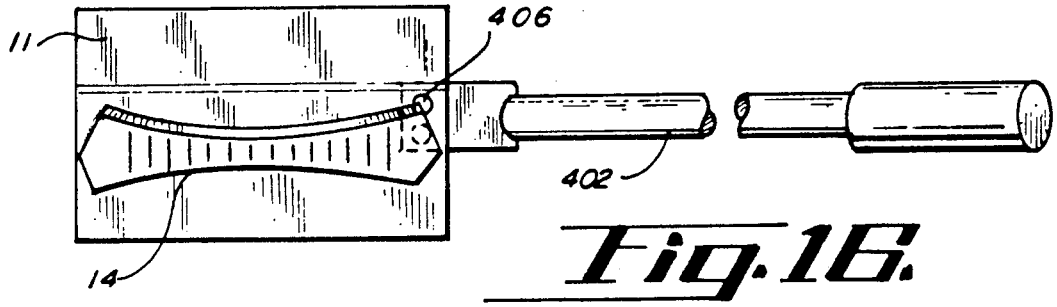
FIG. 16 is a top plan view of another form of the extension handle for the cutter.
Figure 17:
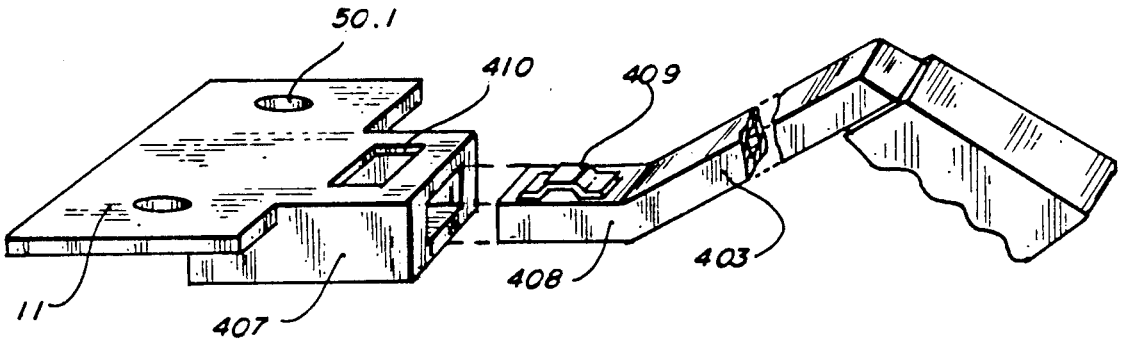
FIG. 17 is an isometric view of another form of the extension handle for the cutter.

As shown in FIGS. 15–17, elongate extension handles 401–403 allow a contractor to easily cut grooves across a 4 foot or 8 foot piece of fiberglass ductboard from one side of the board by extending one's reach beyond that which could be extended by a person merely grasping the handle 14 and cutting grooves.

The extension handles 401–403 may be attached in a fixed, rotating, or translating manner to the sled 11 or handle 14 of a mounting receptacle either in a permanent or removable manner. For instance, extension handle 401 is fixed to the sled 11 via pin connectors 404 extending through integral prongs 405 of the extension handle 401. Extension handle 402 is fixed to the sled 11 via removable screws 406. Extension handle 403 is removably fixed to the sled 11 via a box-like receptacle 407 receiving an extension portion 408 having a resilient pushbutton 409 receivable in opening 410.

The extension handles 401–403 may range in length from 2 inches to 6 feet. The shorter lengths accommodate cutting grooves in ductboard placed on an appropriate height table while the longer lengths accommodate ductboard placed on the ground with grooves being cut from the standing position.

The extension handle may have a fixed length or have a means for length adjustment such as a telescoping means and/or be interchangeable to accommodate various length members.

The extension handle may be straight, dog legged, such as handle 403, or other shaped such that when it is attached to the fiberglass panel cutter 10 and is grasped and translated in grooving operation by the user, it exerts an adequate combination of vertical and horizontal forces such that the cutter 10 glides on top of the ductboard while cutting grooves in a manner equal to that while grooving ductboard by merely grasping the handle 14.

The extension handle may also be an integral part or extension of handle 14. The extension handle may also screw on and off like a broom handle or click on and off like a socket wrench set.

The present invention may be embodied in other specific forms without departing from the spirit or essential attributes thereof. Therefore, the present methods should be considered in all respects as illustrative and not restrictive, reference being made to the appended claims rather than to the foregoing description to indicate the scope of the invention.

I claim:

1. A tool for cutting grooves in ductboard and forming corresponding scrap pieces of ductboard, the tool having a direction or travel, the tool comprising a sled having a lower surface for bearing against the ductboard, a handle mounted on the sled for manipulating the tool, a blade secured to the sled and having at least two relatively thin blade sections oriented to lie in the direction of travel, each of the blade sections including a front cutting edge portion, each of the thin blade sections and its respective cutting edge portion being disposed angularly of the other thin blade section and its respective cutting edge portion and shaped for cutting the grooves and forming the scrap pieces of ductboard, one of the thin blade sections and its respective cutting edge portion being disposed at a substantial angle relative the lower surface of the sled, and the blade having a defection portion spaced from and extending transversely of one of the cutting edge portions to displace the scrap pieces of ductboard from their respective grooves whereby the scrap pieces of ductboard are easily removable by hand from the ductboard.

2. The tool according to claim 1, wherein the defection portion extends upwardly toward the handle.

3. The tool according to claim 1, wherein each of the thin blade sections includes a rear edge portion, the deflection portion being disposed on one of the rear edge portions.

4. The tool according to claim 1, wherein the blade includes a horizontal blade section and the deflection portion is disposed on the horizontal blade section.

5. The tool according to claim 1, wherein the blade includes an angled blade section and the deflection portion extends from the angled blade section.

6. The tool according to claim 1, wherein the defection portion includes a semi-circular edge portion.

7. A tool for cutting grooves in ductboard and forming corresponding scrap pieces of ductboard, the tool having a direction of travel, the tool comprising a sled having a lower surface for bearing against the ductboard, a handle mounted on the sled for manipulating the tool, a blade secured to the sled and having at least two relatively thin blade sections oriented to lie in the direction of travel, each of the blade sections including a front cutting edge portion, each of the thin blade sections and its respective cutting edge portion being disposed angularly of the other thin blade section and its respective cutting edge portion and shaped for cutting the grooves and forming the scrap pieces of ductboard, one of the thin blade sections and its respective cutting edge portion being disposed at a substantial angle relative the lower surface of the sled, and resilient adjusting means fastened to the sled and the blade for resiliently adjusting the height of the cutting edge portions relative to the lower surface of the sled for controlling the depth of the groove.

8. The tool according to claim 7, wherein the adjusting means includes means for incrementally drawing the blade toward and away from the lower surface of the sled, the drawing means fastened to the sled and the blade.

9. The tool according to claim 8, wherein the blade includes a threaded insert and the drawing means includes a knob mounted on the sled and having a threaded shaft extending through the sled, the threaded shaft cooperating with the threaded insert for incrementally adjusting the relative height of the blade.

10. The tool according to claim 8, wherein the resilient adjusting means is mounted at least partially between the blade and the sled for biasing the blade and sled away from each other.

11. The tool according to claim 7 wherein the sled includes an inner wall and the blade includes a blade mount bearable against the inner wall for maintaining the blade in the direction of travel.

12. A tool for cutting grooves in ductboard and forming corresponding scrap pieces of ductboard, the tool having a direction of travel, the tool comprising a sled having a lower surface for bearing against the ductboard, a handle mounted on the sled for manipulating the tool, a blade secured to the sled and having at least two relatively thin blade sections oriented to lie in the direction of travel, each of the blade sections including a front cutting edge portion, each f the thin blade sections and its respective cutting edge potion being disposed angularly of the other thin blade section and its respective cutting edge portion and shaped for cutting the grooves and forming the scrap pieces of ductboard, one of the thin blade sections and its respective cutting edge portion being disposed at a substantial angle relative the lower surface of the sled, and linear channels formed in the lower surface of the sled and being substantially parallel to each other and running in the direction of travel to guide the sled and blade in a line across and through the ductboard and facilitate easy sliding on the ductboard.

13. The tool according to claim 12, wherein the sled includes at least two spaced apart lower surfaces, the blade extending between the lower surfaces, the channels being formed in each of the lower surfaces.

14. A tool for cutting grooves in ductboard and forming corresponding scrap pieces of ductboard, the tool having a direction of travel, the tool comprising a sled having a lower surface for bearing against the ductboard, a blade secured to the sled and having at least two relatively thin blade sections oriented to lie in the direction of travel, each of the blade sections including a front cutting edge portion, each of the thin blade sections and its respective cutting edge portion being disposed angularly of the other thin blade section and its respective cutting edge portion and shaped for cutting the grooves and forming the scrap pieces of ductboard, one of the thin blade sections and its respective cutting edge portion being disposed at a substantial angle relative the lower surface of the sled, and a handle mounted on the sled for manipulating the tool, the handle including a pair of upwardly extending arms disposed transversely of each other and a gripping portion extending between the arms, the arms being removably and interchangeably securable to the sled so that each of the arms may be secured to the sled forwardly of the other whereby the handle is adaptable for both right handed and left handed operators, the gripping portion being canted relative the lower surface to ergonomically accommodate the cutting of grooves.

15. The tool according to claim 14, wherein the upwardly extending arms are canted relative the lower surface.

16. The tool according to claim 14, wherein the gripping portion is canted between about 5°–20° relative the lower surface of the sled.

17. The tool according to claim 14, wherein the handle portion is canted about 10° relative the lower surface of the sled.

18. The tool according to claim 14, wherein the handle includes an elongate handle extension for manipulating the tool beyond an arm's length.

19. A tool for cutting grooves in ductboard and forming corresponding scrap pieces of ductboard, the tool having a direction of travel, the tool comprising a sled having a lower surface for bearing against the ductboard, a handle mounted on the sled for manipulating the tool, a blade secureable to the sled and having at least two relatively thin blade sections oriented to lie in the direction of travel, each of the blade sections including a front cutting edge portion, each of the thin blade sections and its respective cutting edge portion being disposed angularly of the other thin blade section and its respective cutting edge portion and shaped for cutting the grooves and forming the scrap pieces of ductboard, one of the thin blade sections and its respective cutting edge portion being disposed at a substantial angle relative the lower surface of the sled, the blade including a hole, a blade mount securable to the sled and receiving a pin connector with a head, and a blade plate disposed between the blade mount and blade and affixed to the blade for securing the blade to the sled, the blade plate having a keyhole-like aperture aligned with the hole of the blade so that the blade plate is secured to the blade mount via the head of the pin connector being tightened against the blade plate when the pin connector is in the keyhole-like aperture and so that the blade plate and blade are readily removable form the blade mount by virtue of the head of the pin connector being receivable through the keyhole-like aperture, the keyhole-like aperture including two aperture portions, one aperture portion having a greater spatial dimension than the other aperture portion, the head of the pin connector being insertable through one aperture portion and uninsertable through the other aperture portion.

* * * * *

UNITED STATES PATENT AND TRADEMARK OFFICE

CERTIFICATE OF CORRECTION

PATENT NO. : 5,040,297

DATED : August 20, 1991

INVENTOR(S) : Jeffrey V. Scheinost, et al.

It is certified that error appears in the above-identified patent and that said Letters Patent is hereby corrected as shown below:

Title page, after "[75] Inventor: Jeffrey V. Scheinost, Dayton, Minn." please insert --Gerald J. Keymer, St. Cloud, Minn.
James K. Rancour, Sauk Rapids, Minn.--.

Signed and Sealed this

Third Day of March, 1992

*Attest:*

HARRY F. MANBECK, JR.

*Attesting Officer*

*Commissioner of Patents and Trademarks*